US008398367B2

(12) United States Patent
Agara et al.

(10) Patent No.: US 8,398,367 B2
(45) Date of Patent: Mar. 19, 2013

(54) EXTRACTION UNIT FOR TURBINE AND RELATED METHOD

(75) Inventors: Karthik Gopal Rao Agara, Banglore Karnataka (IN); Daniel Ross Predmore, Ballston Lake, NY (US); Edward John Sharrow, Scotia, NY (US)

(73) Assignee: General Electric Company, Schenectady, NY (US)

( * ) Notice: Subject to any disclaimer, the term of this patent is extended or adjusted under 35 U.S.C. 154(b) by 933 days.

(21) Appl. No.: 12/368,479

(22) Filed: Feb. 10, 2009

(65) Prior Publication Data

US 2010/0202879 A1 Aug. 12, 2010

(51) Int. Cl.
*F01D 25/28* (2006.01)

(52) U.S. Cl. ..... 415/213.1; 415/144; 415/147; 60/39.182

(58) Field of Classification Search ..... 415/144, 415/147, 213.1; 60/39.182
See application file for complete search history.

(56) References Cited

U.S. PATENT DOCUMENTS 1,950,088 A * 3/1934 Ljungstrom ..... 415/60
3,289,408 A * 12/1966 Silvestri, Jr. ..... 60/678
3,630,635 A * 12/1971 Fatum ..... 415/214.1
3,966,355 A * 6/1976 Pierpoline ..... 415/144
4,915,581 A * 4/1990 Groenendaal et al. ..... 415/213.1

* cited by examiner

*Primary Examiner* — Thinh T Nguyen
(74) *Attorney, Agent, or Firm* — Ernest G. Cusick; Hoffman Warnick

(57) ABSTRACT

An extraction unit for a steam turbine includes an end plate mounted downstream of a selected stage of a steam turbine, the end plate sealing the selected stage from the atmosphere, and an extraction pipe passing through the end plate for extracting steam from the selected stage.

19 Claims, 6 Drawing Sheets

EXTRACTION UNIT FOR TURBINE AND RELATED METHOD

BACKGROUND OF THE INVENTION

The invention relates generally to turbine technology. More particularly, the invention relates to an extraction unit for converting a turbine or adding extraction outlets to a turbine.

Two types of steam turbines used in industry are a condensing steam turbine and an extraction steam turbine. A condensing steam turbine exhausts steam in a partly condensed state, while in an extraction steam turbine steam is pulled from various locations and used for other industrial processes such as preheating water boilers, etc. Valves control steam extracted from an extraction steam turbine.

SUMMARY OF THE INVENTION

A first aspect of the disclosure provides an apparatus comprising: an end plate mounted downstream of a selected stage of a steam turbine, the end plate sealing the selected stage from the atmosphere; and an extraction pipe passing through the end plate for extracting steam from the selected stage.

A second aspect of the disclosure provides a steam turbine comprising: a plurality of stages, each stage including a plurality of rotating blades coupled to a rotating shaft; an end plate mounted downstream of a selected stage, the end plate sealing the selected stage from the atmosphere and including a rotating shaft opening allowing the rotating shaft to sealingly pass through the end plate; and an extraction pipe passing through the end plate for extracting steam from the selected stage.

A third aspect of the disclosure provides a method comprising: providing a steam turbine including at least one stage; and adding extraction outlets to the steam turbine by sealingly mounting an end plate downstream of a selected stage of the steam turbine, the end plate including an extraction pipe passing through the end plate for extracting steam from the selected stage.

DETAILED DESCRIPTION OF THE INVENTION

Figure 1:
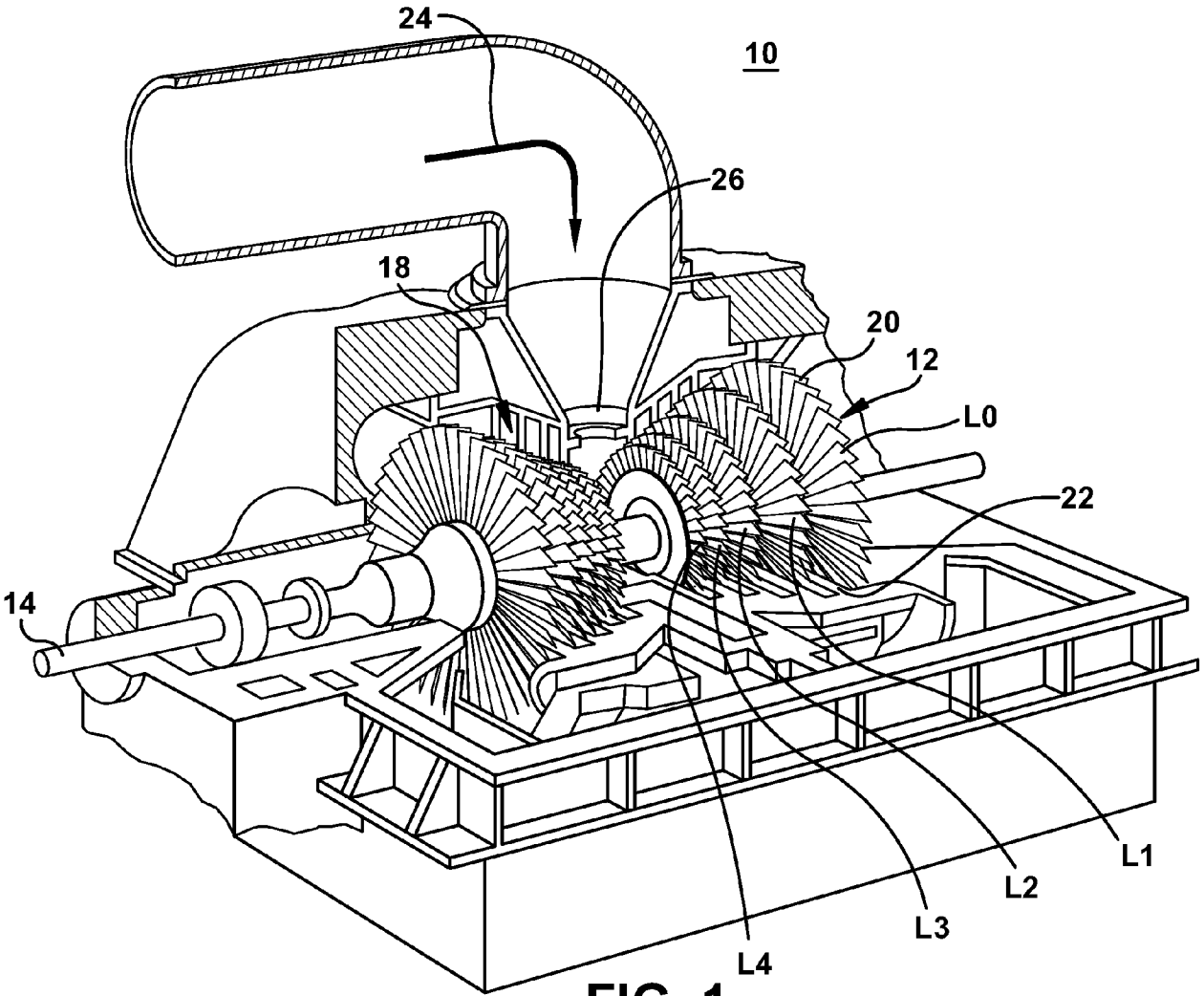
FIG. 1 shows a perspective partial cut-away illustration of a steam turbine.

Referring to the drawings, FIG. 1 shows a perspective partial cut-away illustration of a double flow, low pressure steam turbine 10, which is just one example of the type of steam turbine to which the teachings of the invention may be applied. Steam turbine 10 includes a rotor 12 that includes a rotating shaft 14 and a plurality of axially spaced rotor wheels 18. A plurality of rotating blades 20 are mechanically coupled to each rotor wheel 18. More specifically, blades 20 are arranged in rows that extend circumferentially around each rotor wheel 18. A plurality of stationary vanes 22 extends circumferentially around shaft 14, and the vanes are axially positioned between adjacent rows of blades 20. Stationary vanes 22 cooperate with blades 20 to form a stage and to define a portion of a steam flow path through turbine 10.

In operation, steam 24 enters an inlet 26 of turbine 10 and is channeled through stationary vanes 22. Note, however, that the steam inlet configurations may vary. Vanes 22 direct steam 24 downstream against blades 20. Steam 24 passes through the remaining stages imparting a force on blades 20 causing shaft 14 to rotate. At least one end of turbine 10 may extend axially away from rotor 12 and may be attached to a load or machinery (not shown) such as, but not limited to, a generator, and/or another turbine.

In one embodiment of the present invention as shown in FIG. 1, turbine 10 comprises five stages. The five stages are referred to as L0, L1, L2, L3 and L4. Stage L4 is the first stage and is the smallest (in a radial direction) of the five stages. Stage L3 is the second stage and is the next stage in an axial direction. Stage L2 is the third stage and is shown in the middle of the five stages. Stage L1 is the fourth and next-to-last stage. Stage L0 is the last stage and is the largest (in a radial direction). It is to be understood that five stages are shown as one example only, and each turbine may have more or less than five stages. Also, as will be described herein, the teachings of the invention do not require a multiple stage turbine.

FIGS. 2-5 show an extraction unit 100 for converting a non-extraction type steam turbine 10 to an extraction steam turbine 200 (FIG. 3) or adding additional extraction outlets to an extraction steam turbine. Generally, extraction unit 100 converts a condensing type steam turbine 10 to extraction steam turbine 200 or adds extraction outlets to an extraction type turbine by providing a seal at the selected stage and extraction pipes through which steam can be extracted. Where steam turbine 10 is a condensing type system, it would typically allow the steam therein to condense after all desired work had been extrapolated from the steam. Where steam turbine 10 is already an extraction type steam turbine (other outlets not shown), then extraction unit 100 may add further outlets for steam. In any event, according to embodiments of the invention, steam extracted may be employed in any other now known or later developed industrial application, e.g., a de-salination process, preheating boiler, etc.

Figure 2:
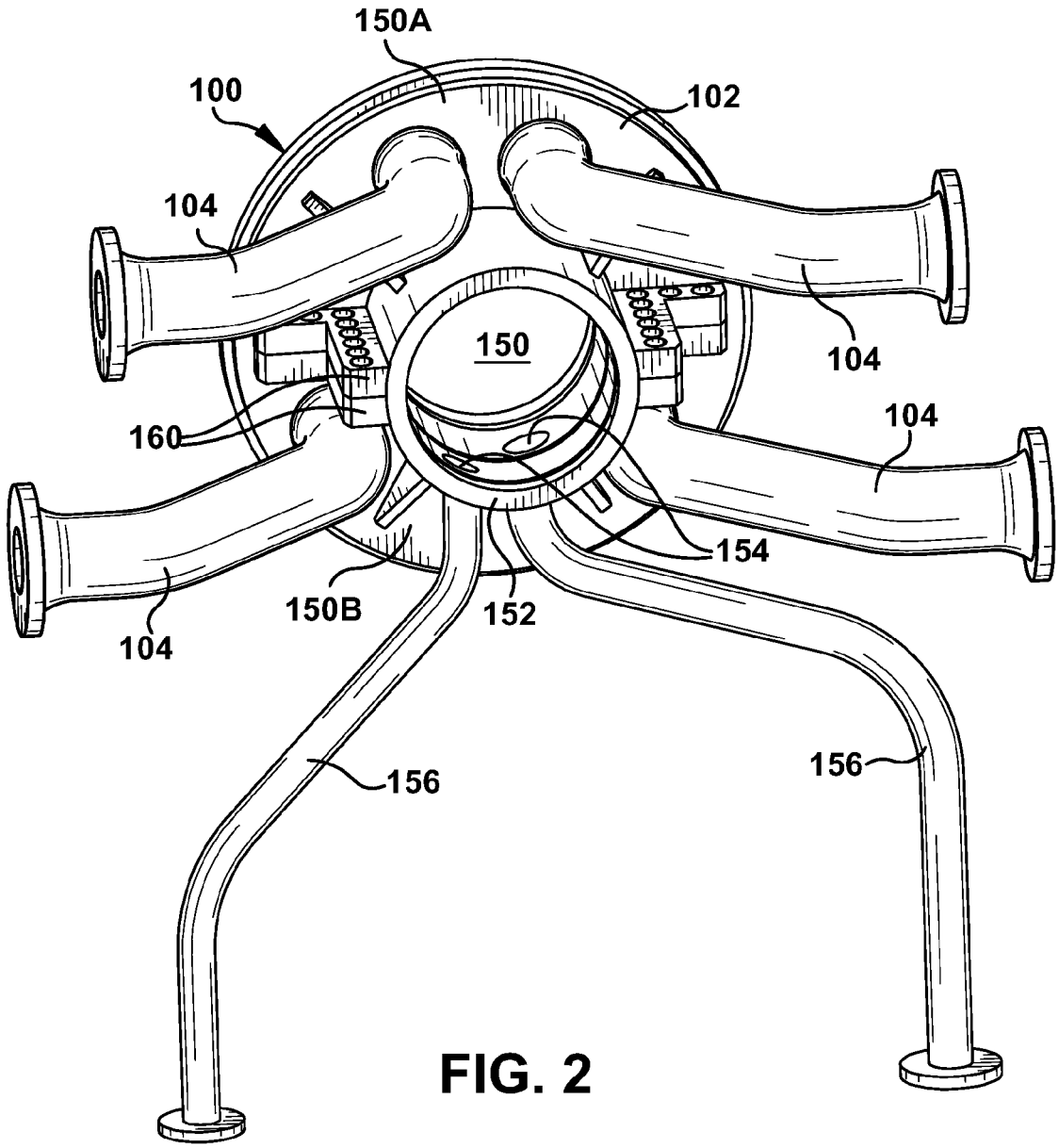
FIG. 2 shows a perspective view of an end plate of an extraction unit for the steam turbine of FIG. 1.
Figure 3:
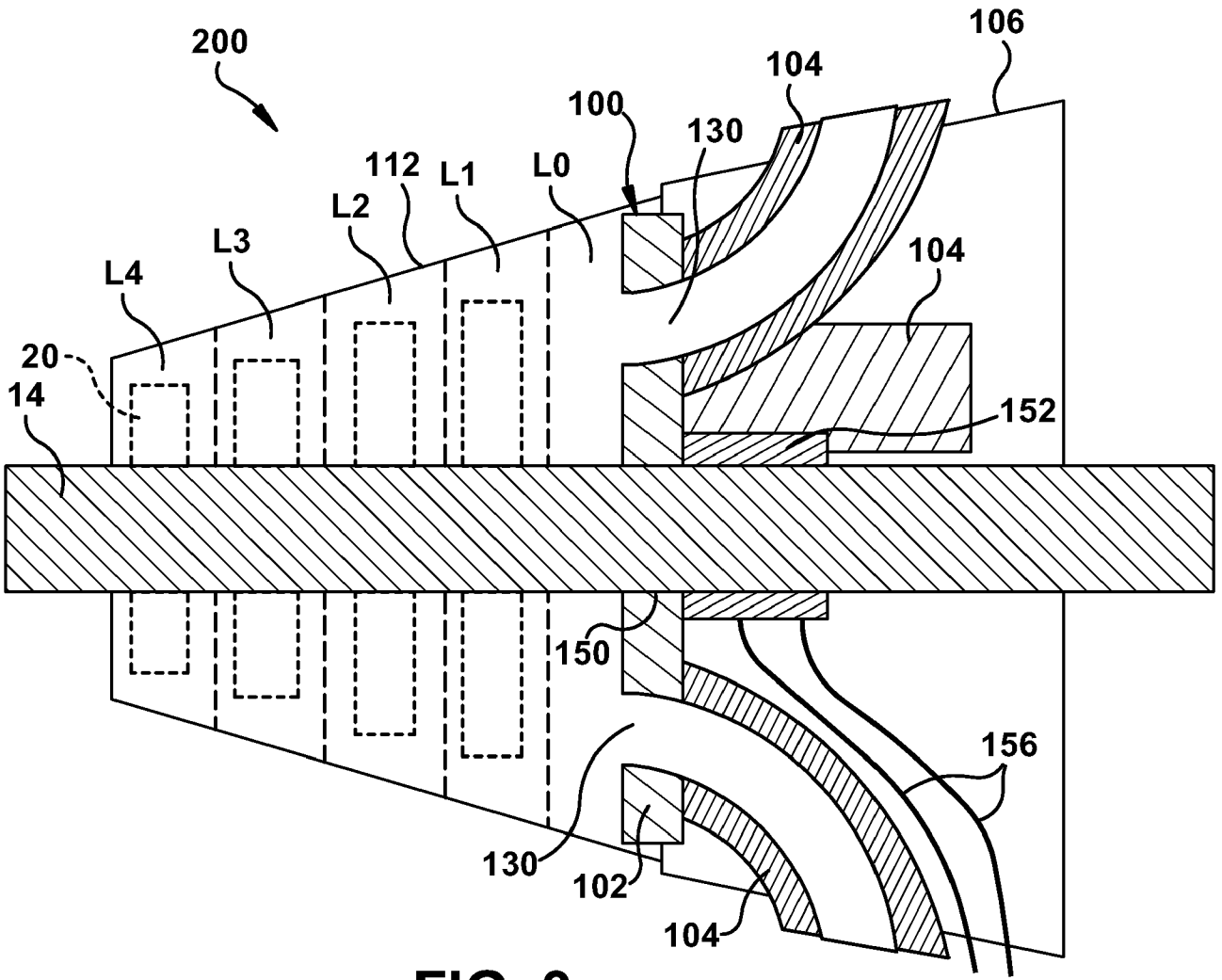
FIG. 3 shows a schematic cross-sectional view of the extraction unit of FIG. 2 installed on the steam turbine.
Figure 4:
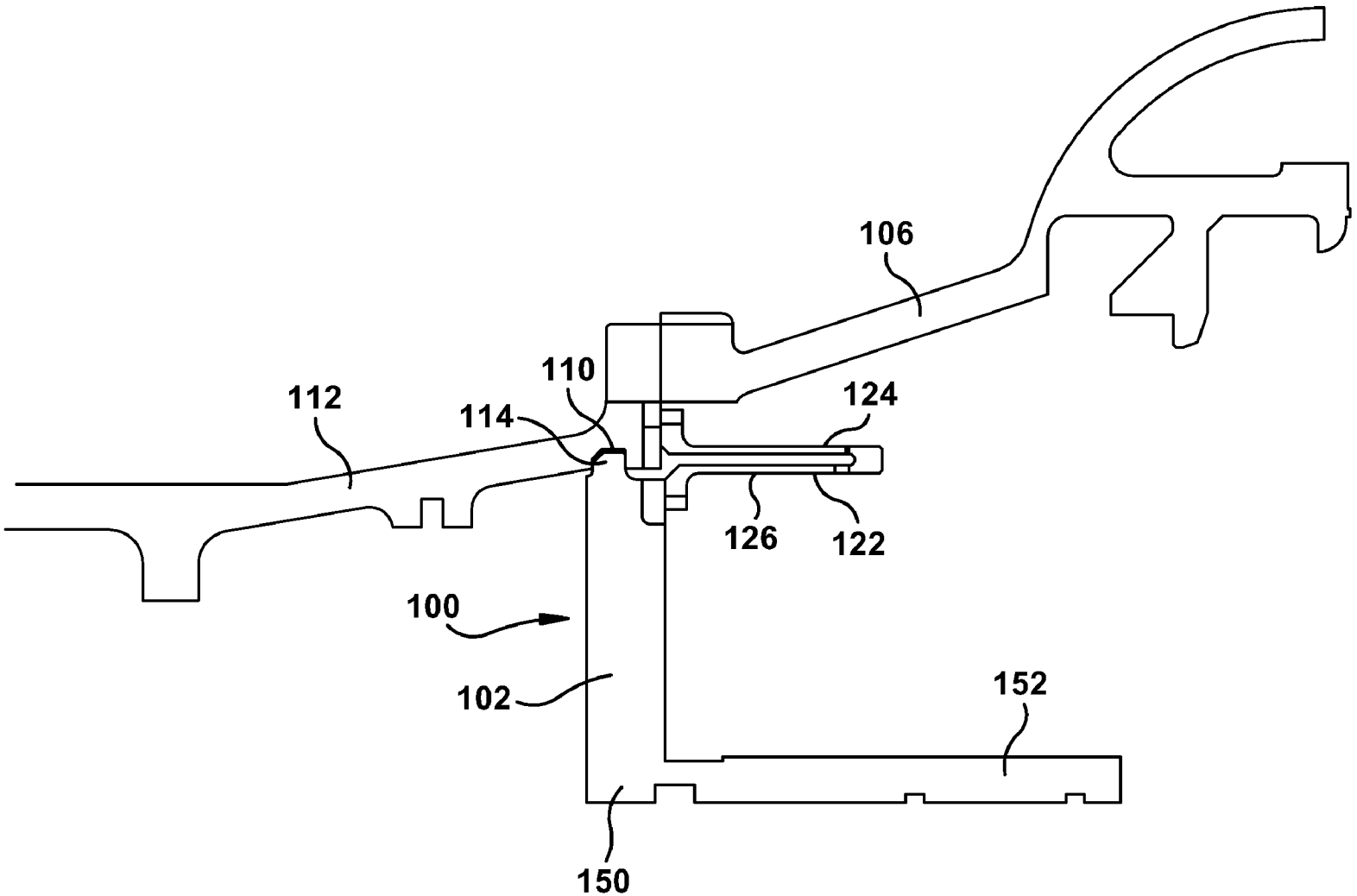
FIG. 4 shows an enlarged, cross-sectional view of the extraction unit of FIG. 2 installed on the steam turbine.
Figure 5:
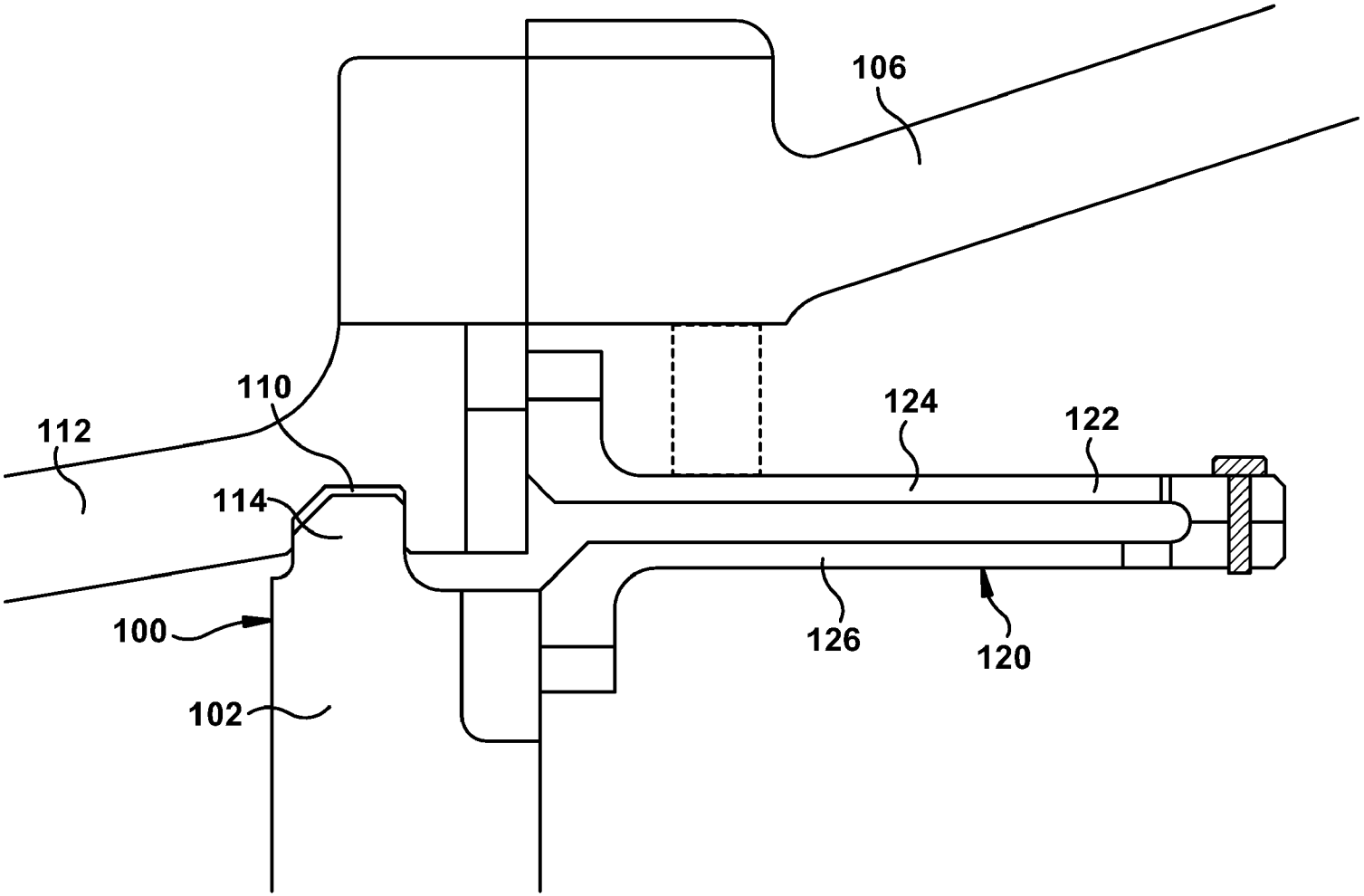
FIG. 5 shows an enlarged, cross-sectional view of a detail of the end plate installed on the steam turbine.

In one embodiment, extraction unit 100 includes an end plate 102 mounted downstream of a selected stage (e.g., L0 in FIG. 1) of steam turbine 10 and one or more extraction pipe(s) 104 passing through the end plate for extracting steam from the selected stage. FIG. 2 shows an embodiment including four extraction pipes 104; FIG. 3 shows an embodiment including three extraction pipes 104, with two aligned with the vertical centerline of end plate 102; and FIGS. 4-5 are devoid of extraction pipes for clarity of illustration. Downstream stages (not shown) from extraction unit 100 may be removed or adjusted to provide clearance for extraction unit 100, perhaps leaving a casing 106 (FIGS. 3-5) therefor. Casing 106 may be at atmospheric conditions. As shown best in FIGS. 3-5, end plate 102 seals the selected stage from the atmosphere. The selected stage may include practically any stage in steam turbine 10. Downstream stages may need to be removed or adjusted to provide clearance for extraction unit 100. Extraction unit 100 may be made of any suitable metal alloy capable of withstanding the steam conditions of the selected stage.

As shown best in FIGS. 4-5, end plate 102 may be mounted in a groove 110 in a casing 112 of steam turbine 10, i.e., by a flange 114 on end plate 102. Groove 110 may be machined in casing 112 using any known technique, or may be provided by the addition of a fixture including the groove. Casing 112 may include the casing surrounding the selected stage, or any other convenient structure capable of immovably fixing end plate 102. In one embodiment, end plate 102 may be sealed to a casing 112 using a flexible seal 120, which seals a periphery of end plate 102 and casing 112. In one embodiment, flexible seal 120 is formed from a metal alloy into a U-shaped member 122 having a first leg 124 thereof coupled to casing 112 and a second leg 126 thereof coupled to the end plate 102. Each leg 124, 126 may be coupled to its respective part by, for example, bolting or welding. In an alternative embodiment, not shown, flexible seal 120 may have a V-shape. Flexible seal 120 may be formed as one integral piece (FIG. 4) or may include two mating halves (FIG. 5), which may be, for example, bolted or welded together. In an alternative embodiment, shown in phantom in FIG. 5, one leg (e.g., 124) of flexible seal 120 may be coupled to structure other than casing 112 such as downstream casing 106. In any event, flexible seal 120 prevents steam leakage from between end plate 102 and casing 112.

Figure 6:
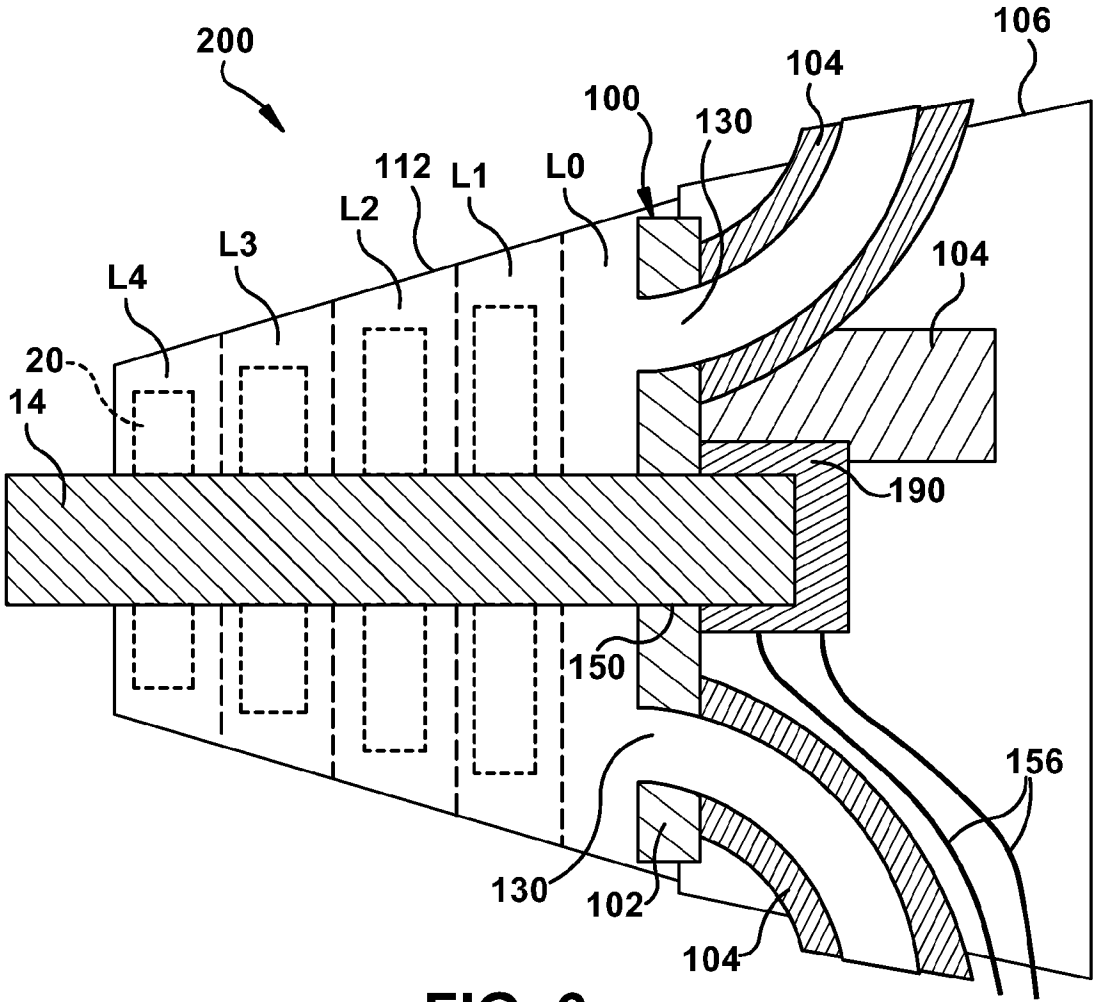
FIG. 6 shows a schematic cross-sectional view of an alternative embodiment of the extraction unit of FIG. 3 installed on the steam turbine.

Referring to FIGS. 2-3, end plate 102 may also include a rotating shaft opening 150 allowing rotating shaft 14 of steam turbine 10 to sealingly pass through the end plate. In one embodiment, a rotating shaft collar 152 may be mounted to end plate 102. As illustrated best in FIG. 2, a pair of steam packing seal openings 154 allowing sealing of collar 152 with rotating shaft 14 in a known fashion may be provided. Openings 154 may include appropriate piping 156 for delivery or removal of steam, as shown in FIGS. 2-3. In an alternative embodiment, shown in FIG. 6, end plate 102 may include an end bearing 190 to support an end of rotating shaft 14. In this case, rotating shaft 14 terminates in end bearing 190.

Extraction pipe(s) 104 may be, for example, welded or bolted to appropriately sized openings 130 in end plate 102. As shown in FIG. 3, extraction pipe(s) 104 may extend through a casing 106 downstream and different than casing 112 in which the selected stage is mounted. This structure may be necessary where casing 106 is not readily removed from steam turbine 10, e.g., because of surrounding structure, costs, safety concerns, etc.

As also shown in FIG. 2, in one embodiment, end plate 102 may include a pair of mating parts 150A, 150B. As illustrated, mating parts 150A, 150B each include a substantially semi-circular plate having a mount 160 for coupling to one another. Mating parts 150A, 150B may be, for example, bolted or welded together. Although in the example shown, mating parts are substantially semi-circular, it should be recognized that end plate 102 may be segmented in a number of different fashions to allow for ease of installation and manufacture. For example, more than two mating parts may be employed such that end plate 102 is more modular so that it may be installed with a user selected number of extraction pipes 104. In this case, the mating parts may be more pie shaped (excluding rotating shaft opening 150). In this case, end plate 102 may include a set number of mating parts, e.g., 6, and a user can select whether a mating part includes an extraction pipe opening 130 or is blank. Each mating part would include appropriate mounts 160 (FIG. 2), steam packing openings 154 (FIG. 2) and flange 114 (FIGS. 4-5) section.

Another embodiment includes steam turbine 200 (FIG. 3) as converted. In this embodiment, turbine 200 includes plurality of stages L4-L0, each stage including plurality of rotating blades 20 coupled to rotating shaft 14. End plate 102 is mounted downstream of a selected stage, and the end plate seals the selected stage from the atmosphere. A rotating shaft opening 150 allows rotating shaft 14 to sealingly pass through the end plate. Extraction pipe(s) 104 pass through end plate 102 for extracting steam from the selected stage.

In another embodiment, a method may include providing steam turbine 10 including at least one stage L4-L0, and adding extraction outlets by sealingly mounting end plate 102 downstream of the selected stage. End plate 102 includes an extraction pipe 104 passing through the end plate for extracting steam from the selected stage. In this fashion, a condensing steam turbine can be converted to an extraction type steam turbine 200 (FIG. 3).

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context, (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 wt %, or, more specifically, about 5 wt % to about 20 wt %", is inclusive of the endpoints and all intermediate values of the ranges of "about 5 wt % to about 25 wt %," etc).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus comprising:

an end plate shaped to connect to a steam turbine axially downstream of a selected stage, the end plate shaped to seal the selected stage from the atmosphere, wherein the end plate is configured to connect to the steam turbine perpendicular to a rotating shaft of the steam turbine and includes a rotating shaft opening adapted to allow the rotating shaft of the steam turbine to pass through the end plate; and an extraction pipe passing through the end plate for extracting steam from the selected stage.

2. An apparatus comprising:

an end plate mounted axially downstream of a selected stage of a steam turbine, the end plate sealing the selected stage from the atmosphere, wherein the end plate is mounted perpendicular to a rotating shaft of the steam turbine and includes a rotating shaft opening adapted to allow the rotating shaft of the steam turbine to pass through the end plate; and an extraction pipe passing through the end plate for extracting steam from the selected stage.

3. The apparatus of claim 2, wherein the extraction pipe includes a plurality of extraction pipes.

4. The apparatus of claim 2, wherein the end plate is mounted in a groove in a casing of the steam turbine.

5. The apparatus of claim 2, wherein the extraction pipe extends through a casing downstream and different than a casing in which the selected stage is mounted.

6. The apparatus of claim 2, wherein the end plate includes a pair of mating parts.

7. The apparatus of claim 6, wherein the pair of mating parts each include a substantially semi-circular plate having a mounting bracket for coupling to one another.

8. The apparatus of claim 2, wherein the end plate further includes a rotating shaft collar including a pair of steam packing seal openings allowing sealing of the rotating shaft collar with the rotating shaft.

9. The apparatus of claim 2, further comprising a flexible seal sealing a periphery of the end plate and a casing of the steam turbine.

10. The apparatus of claim 9, wherein the flexible seal includes a U-shaped member having a first leg thereof coupled to the casing and a second leg thereof coupled to the end plate.

11. A steam turbine comprising:

a plurality of stages, each stage including a plurality of rotating blades coupled to a rotating shaft;

an end plate mounted axially downstream of a selected stage, the end plate sealing the selected stage from the atmosphere and including a rotating shaft opening allowing the rotating shaft to sealingly pass through the end plate, wherein the end plate is oriented in a direction perpendicular to the rotating shaft; and an extraction pipe passing through the end plate for extracting steam from the selected stage.

12. The steam turbine of claim 11, wherein the extraction pipe includes a plurality of extraction pipes.

13. The steam turbine of claim 11, wherein the end plate is mounted in a groove in a casing of the steam turbine.

14. The steam turbine of claim 11, wherein the extraction pipe extends through a casing downstream and different than a casing in which the selected stage is mounted.

15. The steam turbine of claim 11, wherein the end plate includes a pair of mating parts.

16. The steam turbine of claim 15, wherein the pair of mating parts each include a substantially semi-circular plate having a mounting bracket for coupling to one another.

17. The steam turbine of claim 11, wherein the end plate further includes a rotating shaft collar including a pair of steam packing seal openings allowing sealing of the rotating shaft collar with the rotating shaft.

18. The steam turbine of claim 11, further comprising a flexible seal sealing a periphery of the end plate and a casing of the steam turbine.

19. The steam turbine of claim 18, wherein the flexible seal includes a U-shaped member having a first leg thereof coupled to the casing and a second leg thereof coupled to the end plate.

* * * * *